US007537416B2

(12) United States Patent
Wetch

(10) Patent No.: US 7,537,416 B2
(45) Date of Patent: May 26, 2009

(54) RISER SUPPORT SYSTEM FOR USE WITH AN OFFSHORE PLATFORM

(75) Inventor: Stephen B. Wetch, Sugar Land, TX (US)

(73) Assignee: Chevron USA Inc, San Ramon, CA (US)

( * ) Notice: Subject to any disclaimer, the term of this patent is extended or adjusted under 35 U.S.C. 154(b) by 0 days.

(21) Appl. No.: 10/448,812

(22) Filed: May 30, 2003

(65) Prior Publication Data

US 2004/0240947 A1 Dec. 2, 2004

(51) Int. Cl.
*E21B 17/01* (2006.01)
*B63B 22/24* (2006.01)

(52) U.S. Cl. ..... 405/224.2; 405/211; 166/350; 441/133

(58) Field of Classification Search ..... 405/195.1, 405/200, 211, 224, 224.2, 224.4; 166/241.6, 166/350; 441/133
See application file for complete search history.

(56) References Cited

U.S. PATENT DOCUMENTS

| | | | | |
|---|---|---|---|---|
| 4,606,673 | A | 8/1986 | Daniell | 405/210 |
| 4,648,848 | A * | 3/1987 | Busch | 441/5 |
| 4,913,238 | A * | 4/1990 | Danazcko et al. | 405/223.1 |
| 4,995,762 | A | 2/1991 | Goldman | 405/195 |
| 6,227,137 | B1 | 5/2001 | Allen et al. | 114/264 |
| 6,263,824 | B1 | 7/2001 | Balint et al. | 114/264 |
| 6,309,141 | B1 * | 10/2001 | Cox et al. | 405/224 |
| 6,375,391 | B1 * | 4/2002 | Börseth et al. | 405/224.4 |
| 6,431,107 | B1 * | 8/2002 | Byle | 114/264 |
| 6,561,735 | B1 | 5/2003 | Blandford et al. | 405/224.2 |
| 6,644,409 | B1 | 11/2003 | Sromberg et al. | 166/349 |
| 6,666,624 | B2 * | 12/2003 | Wetch | 405/205 |
| 6,688,814 | B2 * | 2/2004 | Wetch et al. | 405/224.2 |
| 6,695,542 | B2 | 2/2004 | Stromberg et al. | 405/224.2 |
| 6,712,560 | B1 * | 3/2004 | Cottrell | 405/224.4 |
| 6,854,933 | B2 | 2/2005 | Horton, III | 405/224.2 |
| 2002/0084077 | A1 * | 7/2002 | Finn et al. | 166/354 |

* cited by examiner

*Primary Examiner*—Tara Mayo-Pinnock
(74) *Attorney, Agent, or Firm*—Steven Christian; Yale Pinkle; Crowell & Moring LLP

(57) ABSTRACT

A riser support system for use in a body of water comprises a buoyant and ballastable support structure and a plurality of substantially vertical and rigid risers each of which is attached to the inside of the support structure at a location below the center of buoyancy of the support structure and below the surface of the body of water. Usually, each riser passes through the inside of a single tube in the support structure. Typically, the riser support system is used to support a plurality of risers and their surface wellheads inside the hull of an offshore platform, usually in such a manner that the axial movement of the risers and support structure is independent of the axial movement of the hull.

7 Claims, 7 Drawing Sheets

50
10
54
52
58
12
72
14
40
64
40
56
60
16
44
42
20
20
2
2
21
38
38
74
25
34
26
34
22
22
64
60
18
24
21
62
62
32

RISER SUPPORT SYSTEM FOR USE WITH AN OFFSHORE PLATFORM

BACKGROUND OF INVENTION

This invention relates generally to floating offshore structures, such as platforms, from which offshore operations, e.g., petroleum drilling and production, can be carried out and the riser support systems for use with these offshore structures. The invention is particularly concerned with riser support systems designed to support surface wellheads and associated equipment, usually on platforms floating in relatively deep water.

As hydrocarbon reserves decline, the search for oil and gas has moved offshore into increasingly deeper waters where economic considerations and physical limitations frequently militate against the use of platforms supported on the ocean or sea floor. Thus, most offshore drilling and production in deep water is conducted from floating platforms that support the drill rig and associated drilling and production equipment. The three types of floating platforms that see the most use in deepwater are tension leg platforms (TLPs), spars and semisubmersible platforms.

Tension leg platforms (TLPs) are moored to the ocean floor using semirigid or axially stiff (not axially flexible), substantially vertical tethers or tendons (usually a series of interconnected members). The TLP platform is comprised of a deck and hull similar in configuration and construction to the semisubmersible platform. The hull provides excess buoyancy to support the deck and to tension the tethers and production risers. The deck supports drilling and production operations. The use of axially stiff tethers tensioned by the excess buoyancy of the hull to moor the platform tends to substantially eliminate heave, roll and pitch motions, thereby permitting the use of surface wellheads and all the benefits that accompany their use.

Another type of floating structure used in offshore drilling and production operations is a spar. This type of structure is typically an elongated, vertically disposed, cylindrical hull that is buoyant at the top and ballasted at its base. The hull is anchored to the sea floor by flexible taut or catenary mooring lines. Although the upper portion of a spar's hull is buoyant, it is normally not ballastable. Substantially all the ballast is located in the lower portion of the hull and causes the spar to have a very deep draft, which tends to reduce heave, pitch and roll motions.

Semisubmersible floating platforms typically consist of a flotation hull usually comprising four or more large diameter vertical columns supported on two or more horizontal pontoons. The columns extend upward from the pontoons and support a platform deck. The flotation hull, when deballasted, allows the platform to be floated to the drill site where the hull is ballasted with seawater to submerge it such that the deck remains above the water surface. The platform is held in position by mooring lines anchored to the sea floor. Partially submerging the hull beneath the water surface reduces the effect of environmental forces, such as wind and waves, and large lateral column spacing results in small pitch and roll motions. Thus, the work deck of a semisubmersible is relatively stable. Although the semisubmersible platform is stable for most drilling operations, it usually exhibits a relatively large heave response to the environment because the pontoons are at a depth that exposes the structure to the rotational energy of large waves.

In order to use surface wells in floating offshore platforms or hulls that are subject to pitch roll and heave motions, such as the semisubmersible and spar platforms described above, the surface wellheads typically must be supported by top tensioning systems and/or individually buoyant risers. Typically, hydraulic top tensioning systems are also required to support risers in TLPs. Top tensioning systems, such as hydraulic cylinder assemblies, add extra weight to the hull supporting the platform, are mechanically complex and add significantly to costs. Individually buoyant risers are relatively complex and expensive subsystems, and the individual buoyancy cans used in these subsystems require significant lateral support and have a large number of moving parts that require close fits and/or a large number of wear or centralizing mechanisms. Thus, the use of individual buoyancy cans results in a large well bay size and increased overall hull size.

It is clear from the above discussion that conventional riser systems needed to support surface wellheads in floating offshore platforms used in deepwater exploration and production have significant disadvantages. Thus, there exists a need for other riser support systems that are mechanically simple and relatively inexpensive for use in these offshore systems.

SUMMARY OF THE INVENTION

In accordance with the invention, it has now been found that rigid and substantially vertical risers and their associated surface wellhead equipment can be effectively and economically supported offshore above the surface of a body of water by a floating apparatus comprising a buoyant and ballastable support structure in which the risers are internally attached at a location below the surface of the body of water and below the center of buoyancy of the support structure. Preferably, each riser is attached to the inside of a tube that is part of the buoyant and ballastable support structure by a latching mechanism or other attachment means.

In one embodiment, the apparatus of the invention is used to support risers and their wellheads in a single hull platform in which the buoyant and ballastable riser support structure is the hull and the risers are attached to the inside bottom of the hull below the center of buoyancy of the hull. In another embodiment, the apparatus of the invention sits in an internal passageway of the hull such that the axial movement of the risers and their support structure is independent of the axial movement of the hull (non-heaved constrained) but moves with the hull (constrained) in pitch and roll. The risers and the riser support structure float inside the hull of the offshore platform and are not anchored to the floor of the body of water by either vertical tethers or flexible moorings.

The apparatus of the invention has significant advantages over conventional methods of supporting risers and their surface wellheads in offshore platforms. The use of a single, relatively simple fabricated structure that provides primary load support to the risers by displacement of water eliminates the need for the use of complex top tensioning mechanisms and individual riser buoyancy cans, thereby reducing costs and complexity of the offshore platform. Furthermore, since the risers are attached to their support structure below its center of buoyancy, the resulting structure is inherently stable and loads into adjoining structures are thereby reduced.

BRIEF DESCRIPTION OF THE DRAWINGS

All identical reference numerals in the figures of the drawings refer to the same or similar elements or features.

DETAILED DESCRIPTION OF THE INVENTION

Figure 1:
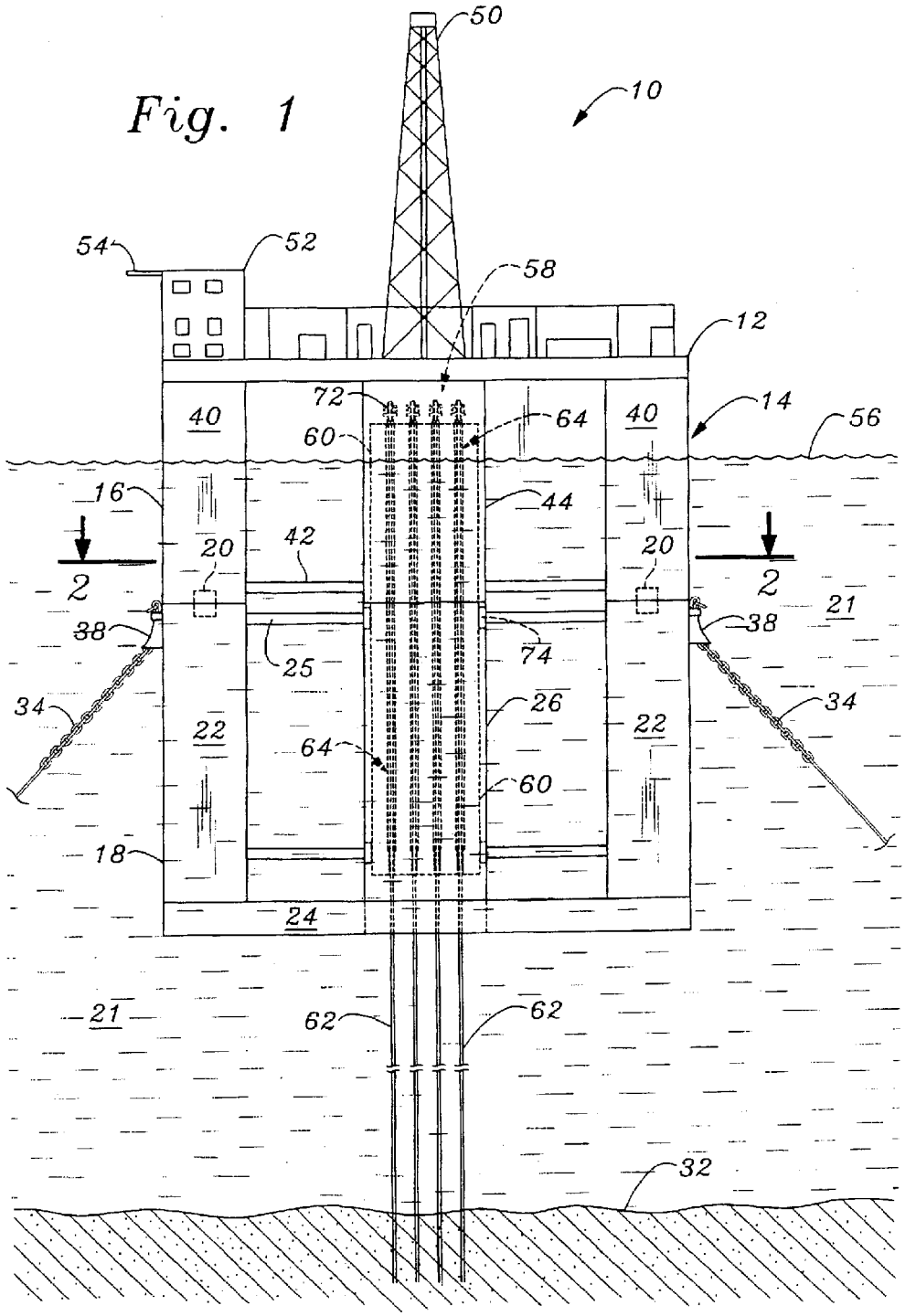
FIG. 1 in the drawings is a side elevation view of an embodiment of the apparatus of the invention used in conjunction with an offshore platform containing two buoyant and ballastable modules or hulls attached to one another such that one is on top the other.
Figure 2:
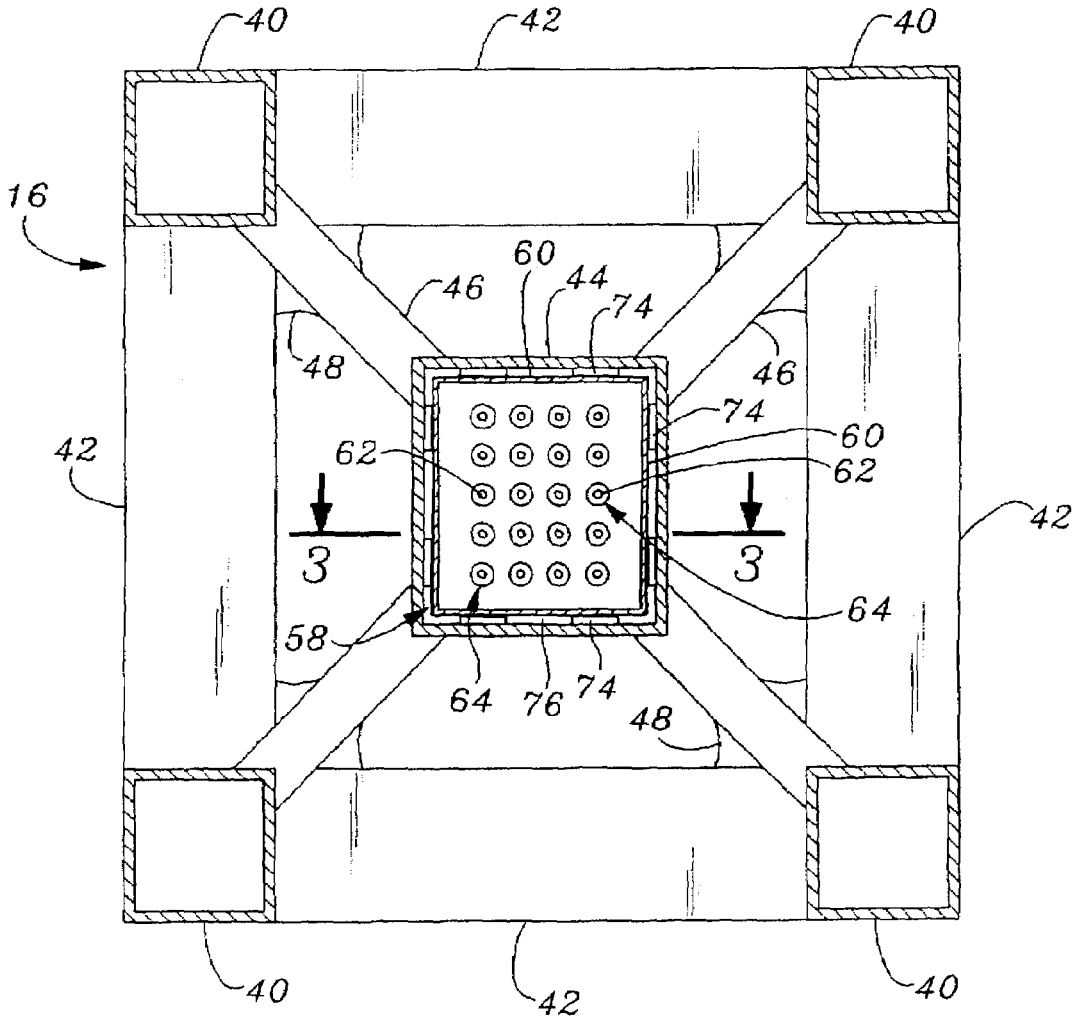
FIG. 2 is a plan view of the apparatus of the invention shown in FIG. 1 taken along the line 2-2.
Figure 3:
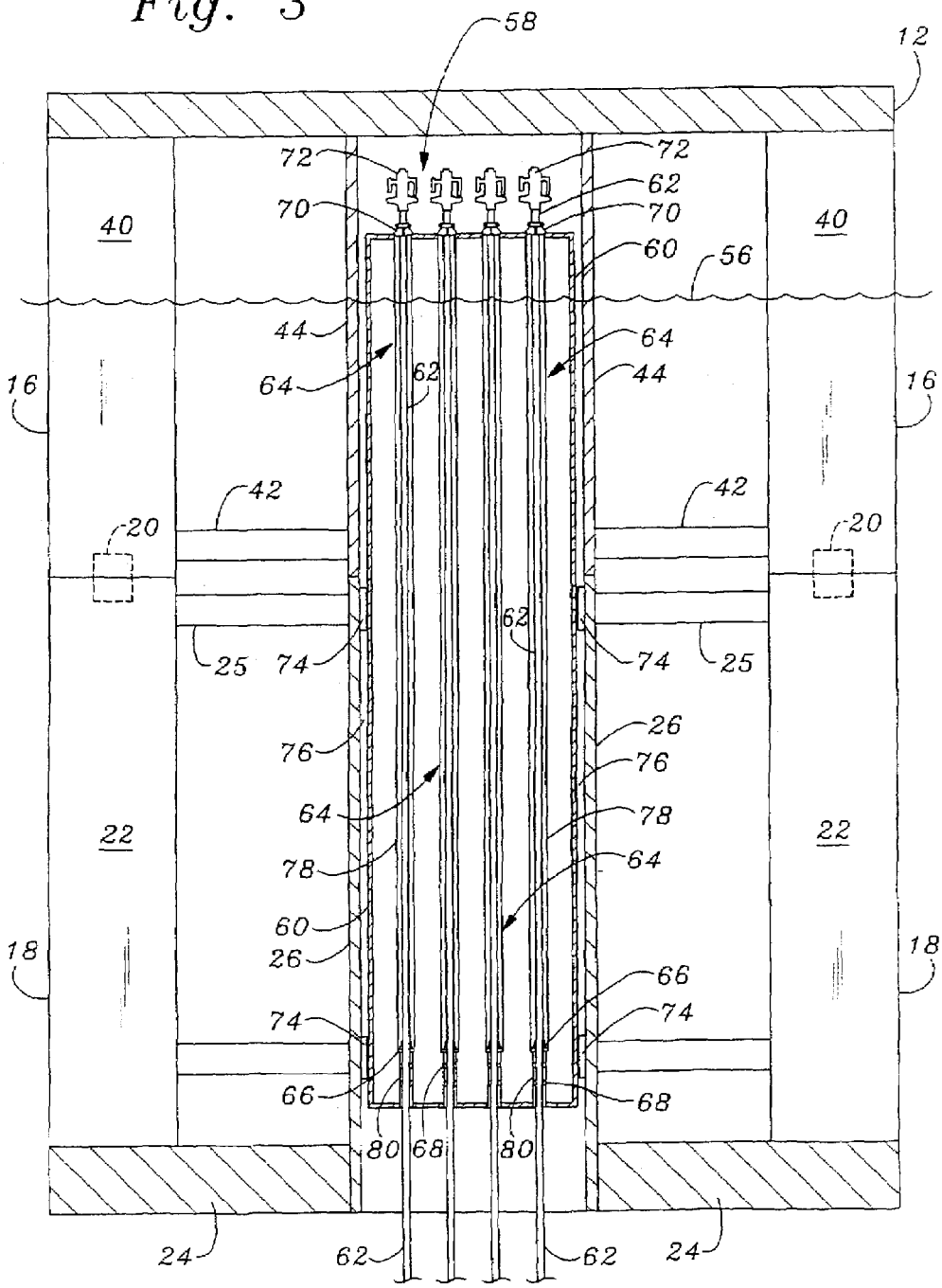
FIG. 3 is an enlarged cross-sectional elevation view of the apparatus of the invention shown in FIG. 2 taken along the line 3-3.

FIGS. 1-3 in the drawings illustrate one embodiment of the riser support system of the invention and its use to support risers and surface wellheads as part of a multiple hull offshore modular platform 10, which is used to conduct drilling, production and/or workover operations in relatively deep water, e.g. water having a depth of between about 1,500 and 13,000 feet. Modular platforms similar to that shown in FIGS. 1-3 are described in detail in U.S. patent application Ser. No. 09/923,685, now U.S. Pat. No. 6,666,624, the disclosure of which patent is hereby incorporated by reference in its entirety. It will be understood, however, that the apparatus of the invention can be used to support risers and surface wellheads in other types of offshore floating platforms, including single hull platforms, or other offshore structures that require low motion support offshore in a body of water having a depth as low as 400 to 800 feet, but typically above 1,000 feet.

The platform 10 comprises deck 12 supported by a floating modular structure 14 that is comprised of upper hull structure 16 and lower hull structure 18. The bottom of upper hull 16 is attached to and fixedly mated with the top of lower hull 18 by hull securing devices 20. These securing devices may be any type of mechanical connector conventionally used to join large tubulars either above or below water. Examples of such connectors include self-locking pipe connectors, marine riser connectors, and hydraulic type connectors. In lieu of or in addition to mechanical connectors, the two hulls can be fixedly joined by permanent welds between the bottom of upper hull 16 and the top of lower hull 18 or by net compression supplied by buoyancy control between the two adjoining hulls as will be described in more detail hereinafter. The modular structure 14 floats in body of water 21 which, for example, may be an ocean, sea, bay or lake.

Lower hull 18 is comprised of four vertical lower hull structural columns 22, four lower hull bottom pontoons 24 and, in some cases, four lower hull top pontoons 25. The hull also contains a lower hull central column or well bay structure 26 that is connected to columns 22 by lower hull diagonal tubulars and lower hull gusset plates, not shown in the drawings, which are similar to those used in upper hull 16 and described hereinafter.

Lower hull 18 is anchored to the floor 32 of body of water 21 by mooring lines 34 and piles or other anchoring devices 36 (FIG. 5) to prevent large horizontal movements of modular structure 14. Normally, sets of two, three or four mooring lines are attached to each of the four lower hull columns 22. The mooring lines 34 may be taut, as shown in FIG. 1, or catenary and usually comprise a combination of steel chain and wire or synthetic rope as shown in FIG. 1. These mooring lines are flexible and usually oriented in a substantially non-vertical position, usually from about 20 degrees to about 55 degrees from the vertical position, depending on the depth of body of water 21. These characteristics distinguish them from the tendons used to anchor TLPs, which tendons are typically a series of interconnected semirigid members oriented in a substantially vertical position. The mooring lines 34 are attached to the lower hull 18 using fairlead and chain stopper assemblies 38.

The upper hull 16 (FIGS. 1-3) is comprised of four vertical upper hull structural columns 40 and, in some cases, four upper hull pontoons 42. The upper hull also contains an upper hull central column or well bay 44 that is connected to columns 40 by upper hull diagonal tubulars 46 and upper hull gusset plates 48.

The combination of upper hull 16 stacked on top of and fixedly attached to lower hull 18 forms floating modular structure 14, which in turn supports deck 12. In the offshore platform shown in FIG. 1, deck 12 is used to support conventional oil and gas drilling and production equipment including drilling rig 50, crew quarters 52 and heliport 54. As pointed out above, however, deck 12 can be used to support other operations besides oil and gas drilling, production and workover.

As shown in FIG. 1, the heights of upper hull 16 and upper well bay 44 are less than the heights of lower hull 18 and lower well bay 26. Although this is the usual case, the heights of the two hulls and well bays may be the same or the heights of the upper hull and upper well bay may be greater than those of the lower hull and lower well bay. Normally, the height of each individual hull and well bay ranges from about 80 to about 150 feet, preferably between about 100 and about 125 feet. The height of upper hull 16 and upper well bay 44 is usually kept under about 125 feet to facilitate its fabrication in dry dock and the attachment of deck 12. Such heights make it possible to build the individual hulls in conventional size shipyards or other fabrication facilities without the need for employing extra large construction equipment, such as oversized cranes and dry docks.

Each hull 16 and 18 is designed to be both buoyant and ballastable and therefore contains ballast compartments or tanks, not shown in the drawings. These ballast compartments are usually located in lower hull bottom pontoons 24, in upper hull pontoons 42 if present, in lower hull columns 22 and in upper hull columns 40, thereby giving each hull adjustable ballast capability. Obviously, each hull contains equipment associated with the ballast compartments, such as manifolds, valves and piping, which allow ballast, typically seawater, to be transferred in or out of the ballast compartments to adjust the position of each hull in the water 21.

Since it is the buoyancy of modular structure 14 that supports deck 12 and its payload of associated equipment, the size of the columns and pontoons will typically depend on the size of the payload. Normally, the width and length of the lower hull columns 22 and the upper hull columns 40 range between about 20 and 60 feet, while the height of the columns usually is between about 70 and 120 feet. The width of lower hull bottom pontoons 24, lower hull top pontoons 25, and upper hull pontoons 42 is typically the same as the width of columns 22 and 40 while the length varies from about 50 to about 230 feet. The pitch and roll motions of modular structure 14 can be decreased by increasing the length of the lower hull bottom pontoons 24 and upper hull pontoons 42 and thereby increasing the distance between the lower hull columns 22 and upper hull columns 40, respectively. Typically, the height of lower hull bottom pontoons 24 is greater than that of lower hull top pontoons 25 and upper hull pontoons 42 and ranges between about 20 and 60 feet. However, it should be understood that it may not be necessary to utilize pontoons 25 and/or 42 in the modular structure 14 as is discussed in more detail below, and they may be eliminated altogether.

The upper and lower hulls 16 and 18 are usually individually ballasted so that modular structure 14 floats in body of water 21 such that the bottom of deck 12 is between about 20 and 60 feet above the water surface 56 and the modular structure 14 has a draft between about 100 and 300 feet, usually greater than about 150 feet and less than about 250 feet. Although a draft of this depth reduces the heave response of platform 10 to a level below that of conventional single hull semisubmersible structures and makes surface well completions feasible, an economical support system for the risers and their associated surface wellheads is still desired. One embodiment of such a support system is depicted in FIGS. 1-3 by reference numeral 58

Riser support system 58 comprises buoyancy can 60, which contains a plurality of tubes 64, and a riser 62 inside each tube. Risers are tubular conduits associated with offshore structures that usually extend from above the ocean surface to the sea floor. They provide pressure integrity and structural continuity between the sea floor and the offshore structure, serve to guide drill strings into well bores in the sea floor, and provide a housing for the tubing that transports produced hydrocarbons from the wells in the sea floor to the water surface. The tubes 64, which are open at the top and bottom and run from the bottom to the top of the can, are structurally fixed to and an integral part of the buoyancy can 60, which has solid sides, a top and a bottom. The tubes provide a barrier between the inside of the buoyancy can and the water that enters the bottom of a tube and occupies the annular space between the inside of a tube 64 and the outside of a riser 62.

As shown in FIGS. 1 and 3, each riser 62 extends upward from the floor 32 of the body of water 21 through the inside of one of the tubes 64 and is attached to the inside of the tube by a remotely operated latching mechanism or similar device 66, usually at a location below both the center of buoyancy of the buoyancy can 60 and the surface of the body of water. The risers are centered inside each tube by two lower centralizers 68 near the bottom of each tube and an upper centralizer 70 on the top of each tube. The two lower centralizers 68 allow the transfer of bending moment and lateral load from the riser to the buoyancy can. The riser support system 58 provides the lateral support and tensioning needed to support wellheads 72 at the top of each riser above the surface 56 of body of water 21. Typically, the riser support system 58 is designed to support between about 4 and 32 risers and their associated surface wellheads.

The buoyancy can 60 is situated inside the passageway formed by the upper and lower well bays 44 and 26 in such a manner that its axial movement is independent of the axial movement of the combined upper and lower hulls 16 and 18. Bearing pads 74 (FIGS. 1-3) located near the top and bottom portions of the lower well bay 26 serve as an interface between the buoyancy can and the lower well bay. The bearing pads are typically made of metal or a low-friction, synthetic material, such as a tertafluorocarbon, and are about the width of the gap 76 between the outside surface of buoyancy can 60 and the inside surface of lower well bay 26. As the buoyancy can moves up and down within the lower well bay 26, the bearing pads slide along wear pads, not shown in the drawings, which are typically stainless steel pads secured to the outer surface of the buoyancy can. In the embodiment of the invention shown in the drawings, there are eight pairs of bearing pads, one pair on each of the four inside walls of lower well bay 26 at two different heights. The number of bearing pads used can vary and will depend upon a number of factors including the shapes of the well bay and buoyancy can.

The use of buoyancy can 60 reduces or eliminates the riser loads on the deck 12 and minimizes deck weight by supporting wellheads 72 and their associated equipment. The upward buoyancy of the buoyancy can counteracts the downward riser force. The buoyancy can contains ballast compartments or tanks, not shown in the drawings, that give the can adjustable ballast capability. The buoyancy can also contains equipment associated with the ballast compartments, such as manifolds, valves and piping, which allow ballast, typically seawater, to be transferred in or out of the ballast compartments to adjust the position of the buoyancy can inside the upper and lower well bays 44 and 26.

Although buoyancy can 60, upper well bay 44 and upper hull 16 are all depicted in FIG. 2 as being in the shape of a square box, i.e., having the same length as width, it will be understood that the width and length of each can be different, i.e., rectangular or quadrilateral, and each can have other shapes, such as triangular, cylindrical and polygonal. Since the buoyancy can is situated inside the well bay and is separated from by it by the small gap 76, it usually has the same general shape as the well bay. Typically, the hull in which the well bay forms a passageway also has the same shape as the well bay and the buoyancy can. The width of the upper hull 16 typically ranges between about 90 and about 280 feet, usually from about 120 to about 250 feet, while the buoyancy can 60 and upper well bay 44 typically have a width between about 30 and about 110 feet. Normally, the lower hull 18 and lower well bay 26 are the same shape as the upper hull 16 and upper well bay 44. Since the buoyancy can sits inside the lower and upper well bays 26 and 44, its height is somewhat less than that of the combined height of the well bays and generally ranges from about 40 to about 180 feet.

Each riser 62 is installed within a separate tube 64 of the buoyancy can 60. Each tube extends the full height of the buoyancy can and, as can be seen in FIGS. 3 and 6A-6D, comprises two sections of different diameters. The upper tube section 78 is about 2 to 15 times the length of lower tube section 80, which forms the bottom of tube 64. The inside diameter of upper tube section 78 typically ranges from about 20 to about 50 inches, while that of lower tube section is usually between about 2 and 4 inches less than that of the upper section. The interface between the two diameter sections forms a horizontal ledge or shoulder 82 (FIG. 6A) that supports latching mechanism or similar clamping device 66. The latching mechanism attaches the riser 62 to the inside of the tube 64 by engaging grooves 84 on the outside of the riser, which typically has an outside diameter between about 7 and about 16 inches. The grooves 84 typically extend around the riser for a length from about 3 to about 12 feet and have an axial pitch of between about 0.5 and 1.0 inch. The latching mechanism is engaged with the grooves by means of a remotely activated latching actuator assembly not shown in the drawings. This assembly enables the latching segments comprising the latching mechanism to be moved away from the riser to allow free vertical passage of the riser through the latching mechanism and, when desired, reverses the motion of the latching segments so they engage the grooves on the riser.

The latching mechanism 66 interfaces with shoulder 82 in tube 64 through a support ring assembly 83 (FIGS. 6A-6D), which comprises two parallel circular plates that incorporate three load cells. These load cells provide real time read out of the riser top tension. Typically, the actual attachment of the riser to the inside of tube 64 occurs at a location within the bottom half, usually within the bottom third, of the height of the buoyancy can 60.

Upper centralizer 70 (FIGS. 3 and 6B-6D) is a split ring and is used to center riser 62 in the top portion of tube 64. It engages the riser and provides upper centralization but no axial support to the riser (i.e., no permanent mechanical top tensioning), which is axially supported in the tube by the latching mechanism 66 at a location below the surface 56 of body of water 21 and below the center of buoyancy of the buoyancy can 60. There is typically no point of attachment of the centralizer and riser to the tube above the water surface. The center of buoyancy is the center of gravity of the fluid displaced by the buoyancy can or other riser support structure. By attaching the risers to the tubes below the center of buoyancy of the buoyancy can or other riser support structure instead of above the surface of the water, the riser support system becomes an inherently stable structure with no overturning moment. This, in turn, reduces the load on bearing pads 74 and the upper and lower hulls 16 and 18, thereby enabling the pads to last longer and simplifying the structure of the hulls as well as the buoyancy can.

Each riser 62 has a load shoulder 86 located above the upper centralizer 70. This load shoulder is shown in FIGS. 6A-6D (but not in the other figures) and supports the riser during temporary tensioning, as described hereinafter, prior to setting the latching mechanism 66. The surface wellhead 72 and its associated equipment are secured to the riser immediately above the load shoulder.

Figure 4:
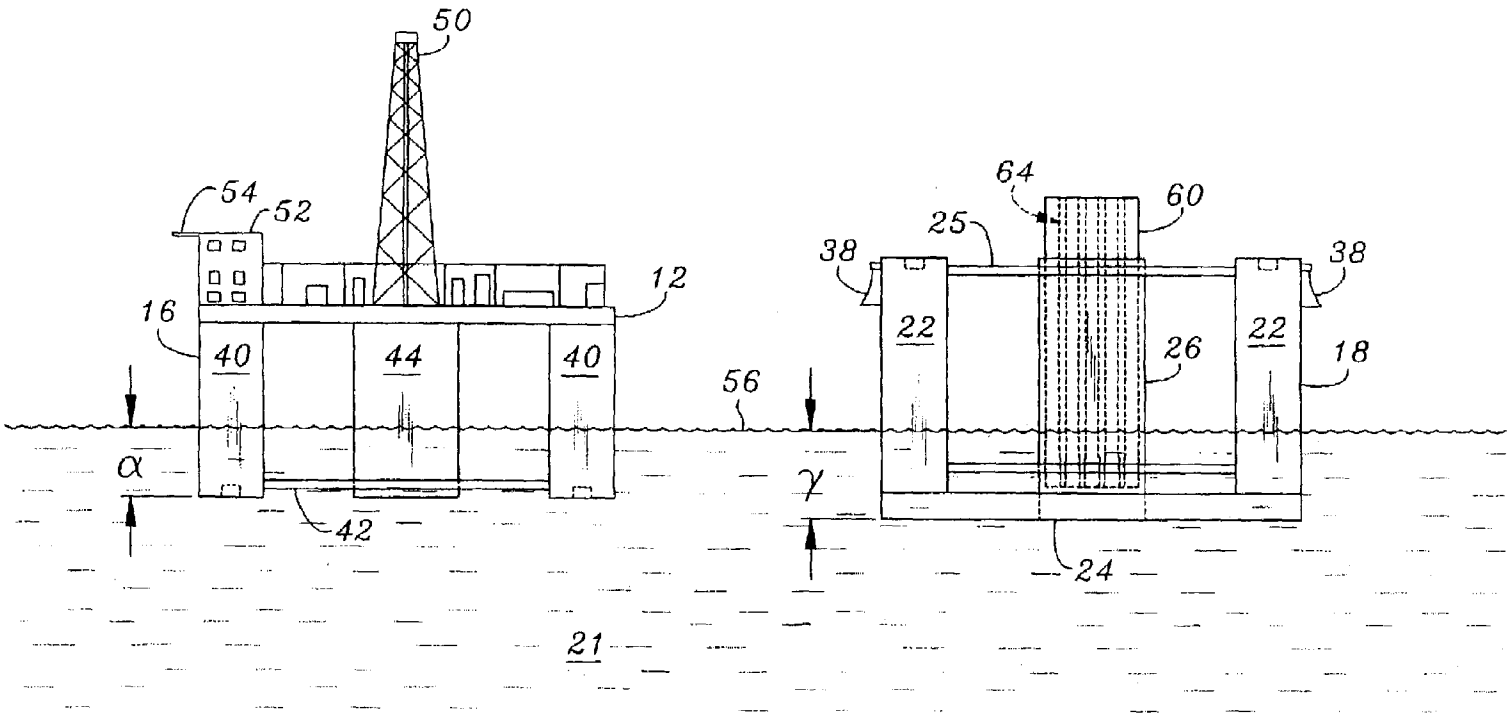
FIG. 4 is a side elevation view showing the upper and lower buoyant and ballastable modules or hulls of FIG. 1 floating separately in a body of water at a preselected offshore location before they are aligned, ballasted and mated.
Figure 5:
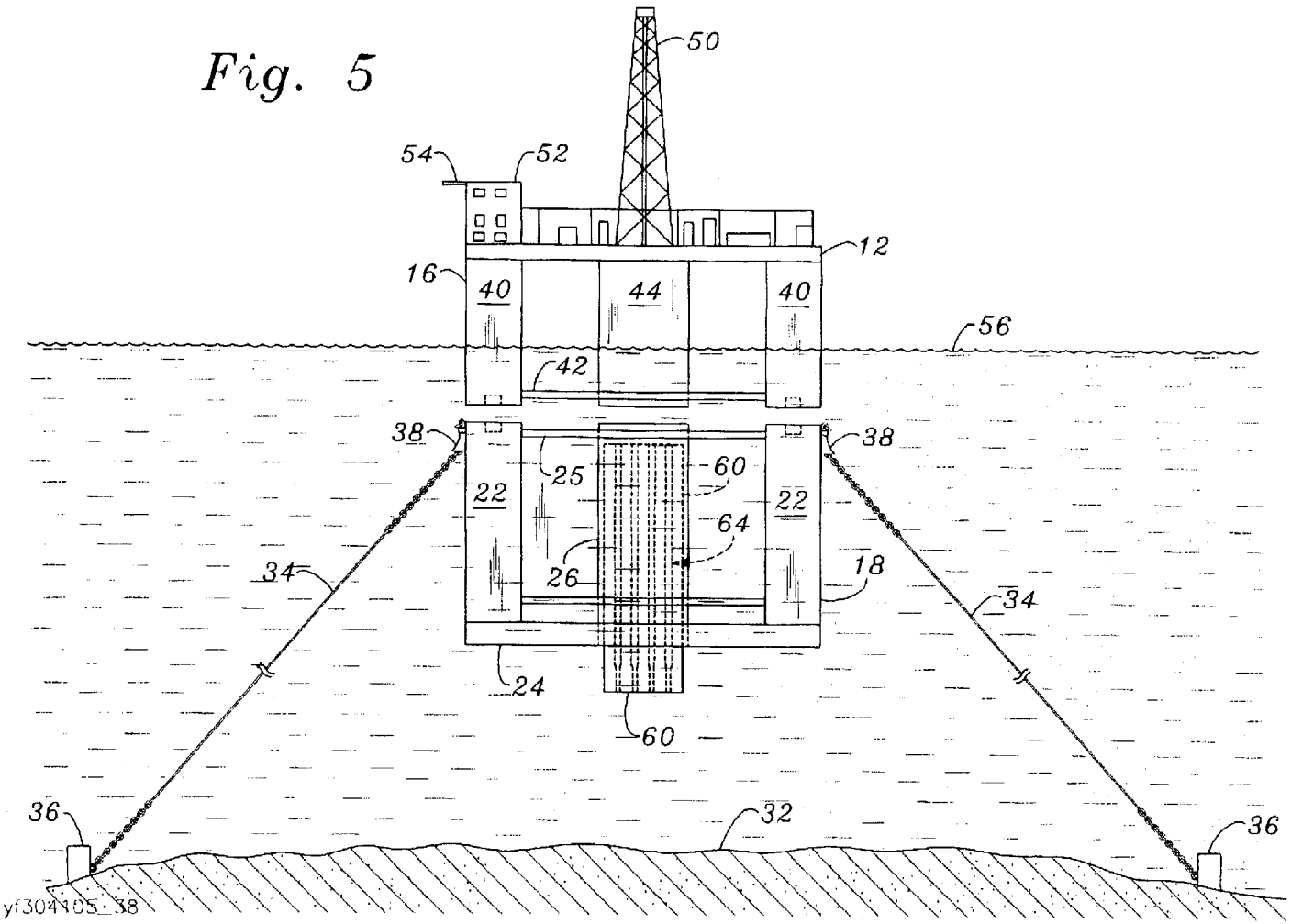
FIG. 5 is a side elevation view showing the upper and lower buoyant and ballastable modules or hulls of FIG. 4 after the lower buoyant and ballastable module has been anchored or moored to the floor of the body of water and the upper module aligned thereover but before the upper and lower modules have been mated.

FIGS. 4 through 6 illustrate one embodiment of the method of installing offshore platform 10 and its associated riser support system. After upper and lower hulls 16 and 18 and buoyancy can 60 with its tubes 64 have been fabricated in the same or separate shipyards, the deck 12 with its associated equipment 50, 52, and 54 has been installed on top of hull 16 in the shipyard and buoyancy can 60 has been placed inside the lower well bay 26 of lower hull 18, the two hulls are individually floated out of the shipyard and separately towed by boat in a low-draft position to the desired assembly or deployment site in body of water 21. FIG. 4 shows the two hulls in their low-draft positions $\alpha$ and $\gamma$ at the desired offshore assembly location after the towboats have departed. During the towing process, upper hull columns 40, upper hull pontoons 42, and upper hull well bay 44 provide the buoyancy required to float upper hull 16 (with deck 12 attached) in its low-draft position $\alpha$ to the desired offshore location. If the weight of deck 12 and its associated equipment is sufficiently low, it may be feasible to design the hull 16 without pontoons 42 and the buoyancy they provide. If the pontoons are not included in the hull, the well bay can be tied to upper hull columns 40 with a conventional open truss structure of tubulars not shown in the drawing.

The buoyancy required for floating lower hull 18 with buoyancy can 60 is provided by lower hull columns 22, lower hull bottom pontoons 24, lower hull top pontoons 25 and the buoyancy can. If the added buoyancy that pontoons 25 provide is not needed, they can be eliminated and replaced with a conventional open truss structure. Such an open structure has the advantage of being transparent to the horizontal movement of water 21 and therefore tends to minimize drag response induced by wave energy and water current.

Once the upper and lower hulls arrive at the desired offshore location, deployment of platform 10 is begun, as shown in FIG. 5. Normally, the first step in deployment is to ballast down the lower hull 18 and the buoyancy can 60 until the top of the lower hull is near the water surface 56 and the top of the buoyancy can is below the top of lower well bay 26. The top of the lower hull is normally far enough above the surface so that workers can stand and work on the top of the hull without being endangered by water and environmental forces. Next, the lower hull 18 is attached to mooring lines 34. Prior to floating the hulls to the desired offshore location, one end of each mooring line is attached to a pile or other anchoring device 36 sunk into the floor 32 of body of water 21. The other end of each mooring line is attached to the end of a lighter weight messenger line, and the mooring line is left lying on the floor 32 of the body of water. The other end of each messenger line is attached to a buoy, not shown in FIG. 5, floating at the water surface 56. The messenger lines are then used to attach the mooring lines to the hull by pulling them into the fairleads 38 using winches or other equipment not shown in the figure. Stoppers above the fairleads hold the mooring lines in place. During the attachment process the hull 18 is pulled down further into the water and the mooring lines are overtensioned by the buoyant forces on the hull.

After the mooring lines have been attached to lower hull 18 and overtensioned, the hull is ballasted down further, usually by pumping water 21 into ballast compartments located in lower hull columns 22 and lower hull bottom pontoons 24, until the lower hull is completely submerged in body of water 21 as shown in FIG. 5 and the tension on the mooring lines is decreased to the desired value.

Upper hull 16, which carries deck 12, is floated over and aligned with completely submerged lower hull 18 so that upper and lower well bays 44 and 26 are aligned as shown in FIG. 5. The upper hull 16 is then ballasted down by pumping water 21 into ballast compartments located in upper hull columns 40 and upper hull pontoons 42, and the bottom used to prevent water from entering upper well bay 44, thereby providing extra buoyancy during the towing of the upper hull, is removed. Enough ballast is added so that the bottom surfaces of the upper hull columns 40 and upper well bay 26 contact and mate with the respective upper surfaces of the lower hull columns 22 and lower well bay 26, usually such that there are no vertical gaps between the column and well bays. In order to obtain proper mating between the surfaces, it may be necessary to selectively and separately ballast and deballast each hull.

Once the upper hull 16 and lower hull 18 are mated, they are normally attached to each other and held together with mechanical locking devices 20. It is possible, however, to weld the contact surfaces together from the inside of the hulls after they have been mated and thereby dispense with permanent locking devices. Alternatively, the hulls can be held together by buoyancy control to keep them in net compression at all times. If after the two hulls are mated there is slack in the mooring lines, it is taken up, usually by the use of winches mounted on upper hull 16, and the lower hull 18 is slightly deballasted to raise the combined hulls enough to induce the desired tension forces in the mooring lines. After the upper and lower hulls 16 and 18 and upper and lower well bays 44 and 26 have been mated, buoyancy can 60 is deballasted so that it rises up into the upper well bay 44, usually to a position above the water surface 56, and no longer extends below the bottom of lower hull 18. By allowing the buoyancy can to pierce the water surface, it becomes less sensitive to changes in load and buoyancy.

Normally, the upper hull is supported entirely by the bottom hull, which is held floating in place by mooring lines 34. The draft of the combined hulls is sufficiently deep to significantly reduce heave, pitch and roll motions while the mooring lines control lateral motion. It is normally not necessary to use other types of anchoring devices, such as substantially vertical and axially stiff tendons on the lower hull. Moreover, the upper hull is typically devoid of mooring lines and tendons. There is no need to directly anchor the upper hull to the floor of the body of water. Its attachment to the lower hull is sufficient to provide it with the required stability.

Figure 6D:
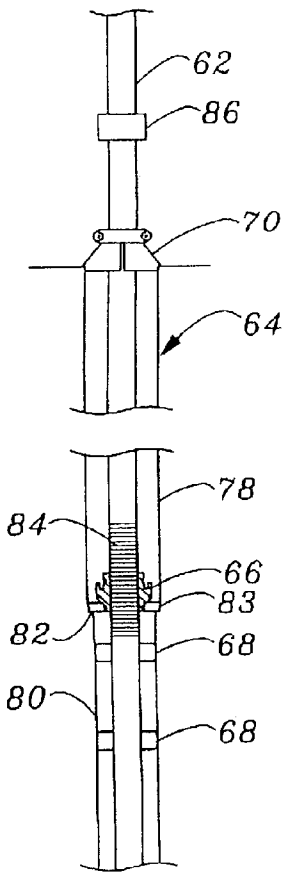
FIGS. 6A through 6D are enlarged cross-sectional elevation views illustrating how a riser is installed in one of the tubes in which it is supported in the apparatus of the invention.
Figure 6C:
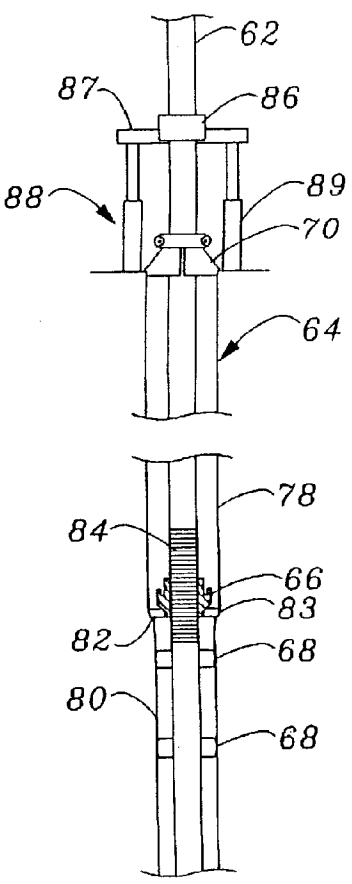

The resultant platform 10 with its buoyancy can 60 situated inside upper and lower well bays 44 and 26 is now ready for the installation of the risers 62 and surface wellheads 72 shown in FIG. 1 and 3. Each riser 62 is run through a tube 64 in buoyancy can 60 using the platform drill rig 50. All components of the riser must pass through the tube. The lower centralizers 68 are preassembled with the upper portion of the riser along with the latching mechanism 66, which is engaged in the grooves 84 on the outside of the riser, its support ring assembly 83 and the remotely activated latching actuator assembly, which is not shown in the drawings. These items are then passed downward into tube 64 with the upper portion of the riser as shown in FIG. 6A. As the riser is lowered, hydraulic control lines for the latching mechanism 66 and electrical lines for the riser load cells are also fed into the tube 64.

Figure 6B:
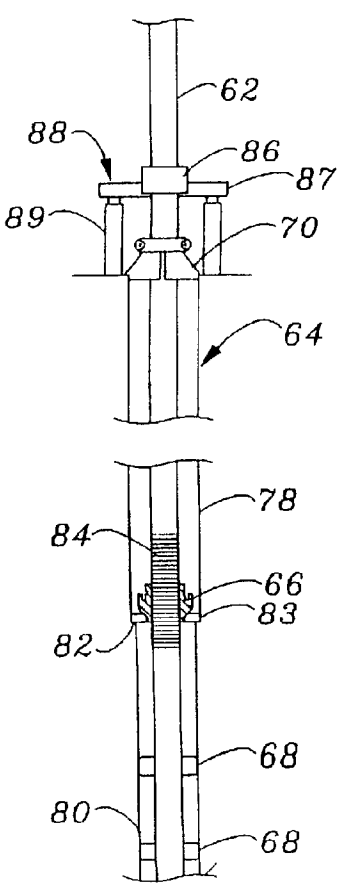
Figure 6A:
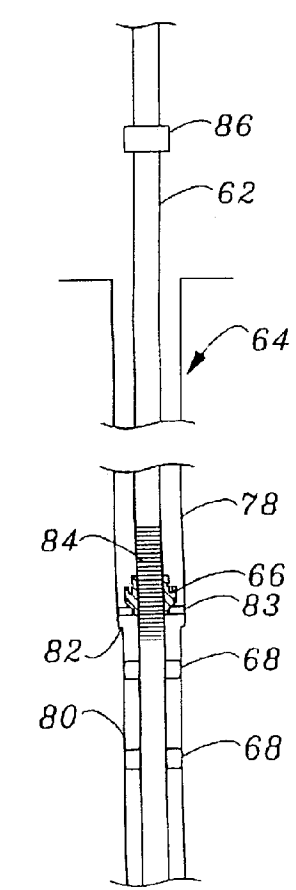

When the latching mechanism 66 and its support ring assembly 83 land on shoulder 82 formed at the interface between upper tube section 78 with lower tube section 80 as shown in FIG. 6B, the latching mechanism is disengaged from the grooves 84 on the outside of the riser by the remote actuator, thereby freeing the riser to be further lowered. The drill rig 50 then applies additional top tension and holds this tension as temporary tensioning jacks 88 and upper centralizer 70 are added to the top of the riser. The temporary tensioning jacks are comprised of a support yoke assembly 87 closed around the load shoulder 86 and a pair of hydraulic cylinders 89.

Next, as shown in FIG. 6C, the hydraulic cylinders 89 of the temporary tensioning jacks 88 are extended, and the load is transferred from the drill rig to the tensioning jacks. At this point the latching mechanism is still held in the open position by the remote latching actuator assembly. Once the riser pretension has been applied and verified by load measurement in the tensioning jacks, the latching mechanism is remotely activated to engage the grooves 84 on the riser, and the load on the tensioning jacks is released to nearly zero. The riser tension is then verified by readings from the load cells in the support ring assembly 83. If the load is satisfactory, the upper centralizer 70 is fixed in place around the riser and the temporary tensioning jacks removed as shown in FIG. 6D. They can then be used for temporarily tensioning another riser as it is installed. If the load is incorrect, the hydraulic cylinders 89 of the tensioning jacks 88 are re-extended, the latching mechanism 66 released, the load adjusted, and the latching mechanism re-engaged. When fixed in place, the upper centralizer completely fills the space between the top of the buoyancy can tube 64 and the riser 62 and incorporates a pathway for the load cell monitoring cables and supporting clamps for these cables. The upper centralizer 70 is attached to the riser but not to tube 64, and therefore does not provide axial support to the riser. Finally, the surface wellhead and its associated equipment are secured to the top of the riser. This process is repeated for each riser until they are all installed and the platform is ready for the drilling of wells through the risers to begin.

The use of the buoyancy can 60 and its tubes 64 to axially support risers 62 in the well bay of offshore platform 10 has several advantages over conventional riser support systems. First, the primary load support is provided through the displacement of water by a single, simply shaped buoyancy can as opposed to expensive and complex riser top tensioning systems or individual riser buoyancy cans. Second, the ability of the risers-buoyancy can structure to move axially in the platform well bay independently of the axial movement of the hull reduces the need for significant heave constrainment of the hull, thereby significantly reducing the size requirements of its moorings and related components.

The embodiment of the riser support system of the invention shown in FIGS. 1-3 and 6 is comprised of a buoyancy can containing a plurality of tubes each of which contains a riser that is attached to the inside of the tube by means of a latching mechanism that engages the outside surface of the riser at a location below the surface of a body of water and below the center of buoyancy of the buoyancy can, which serves as the riser support structure. The buoyancy can and risers are located in a well bay or passageway of an offshore platform that is comprised of two buoyant and ballastable hulls attached one on top the other, and the buoyancy can is able to move axially inside the passageway. It will be understood that the apparatus of the invention is not restricted to the use of a buoyancy can with the risers or the use of a latching mechanism to attach a riser to the inside of a tube. Furthermore, the apparatus of the invention can be used in conjunction with any type of offshore floating platform regardless of whether it is comprised of a single hull or multiple hulls.

Figure 8:
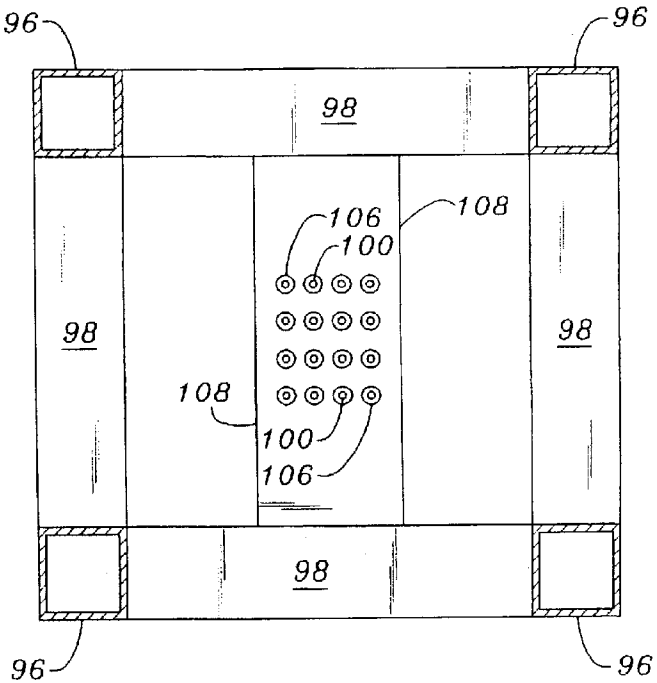
FIG. 8 is a plan view of the apparatus of the invention shown in FIG. 7 taken along the line 8-8.
Figure 7:
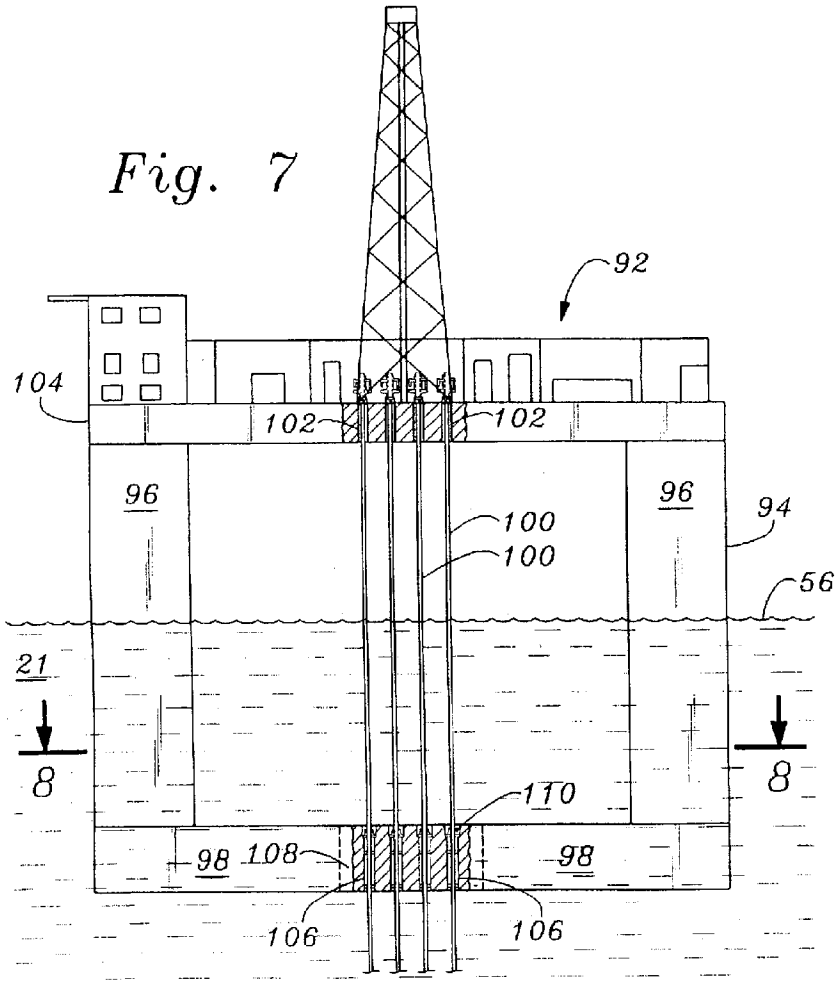
FIG. 7 is side elevation view with cross-sectional cut outs of an alternative embodiment of the apparatus of the invention in which risers are supported in a single buoyant and ballastable hull.

For example, another embodiment of the invention is illustrated in FIGS. 7 and 8. In this embodiment the risers 100 are supported not by a buoyancy can but by a riser support structure that comprises a single hull 94 of offshore platform 92. Hull 94 is comprised of four structural columns 96 and four pontoons 98. The risers 100 pass through tubes 102 in the deck 104 of the platform and through tubes 106 in pontoon bridging structure 108, which runs approximately through the center of the bottom of hull 94 from one pontoon 98 to the opposite parallel pontoon 98 and is fixedly attached to each of these pontoons in such a manner that it cannot move axially in between the pontoons. Normally, pontoon bridging structure 108 is the same height as the pontoons and is buoyant and ballastable. Each riser 100 is attached to the inside of a tube 106 by a latching mechanism 110 similar to the one shown by reference numeral 66 in FIGS. 3 and 6A-6D. The attachment is at a location below the surface 56 of body of water 21 and below the center of buoyancy of hull 94. None of the risers is fixedly attached to the deck 104 or to the inside of tubes 102, and therefore none is permanently tensioned from the top at a location above the surface of body of water 56. This embodiment of the invention is particularly suited for supporting risers and their surface wellheads in platforms used in relatively benign environments, i.e., environments that are subject to low wind and wave energy, where an axially movable buoyancy can 60, as shown in the embodiment of the invention depicted in FIGS. 1-5, is not needed. The overall efficiency and stability of the hull 94 is substantially improved by attaching the risers to the hull at a location below its center of buoyancy.

In the embodiment of the apparatus of the invention depicted in FIGS. 7 and 8, hull 94 is an open structure comprised of pontoons and columns. It will be understood that this embodiment of the invention can be employed with a hull of any structural configuration. For example, the hull structure could be in the form of a barge, a ship or a spar.

In the embodiments of the invention shown in FIGS. 1-6 and FIGS. 7-8, the risers are attached by a latching mechanism inside tubes in a riser support structure, i.e., buoyancy can 60 or hull 94, at a location below the surface of a body of water and below the center of buoyancy of the riser support structure. It will be understood that the apparatus of the invention is not limited to the use of such a latching mechanism. Any means that attaches the riser to the inside of its support structure at a location below the surface of a body of water and the center of buoyancy of the support structure can be used. Examples of such attachment means include fixed load shoulders, hydraulic connections and threadable connectors.

Although this invention has been described by reference to several embodiments and to the figures in the drawing, it is evident that many alterations, modifications and variations will be apparent to those skilled in the art in light of the foregoing description. Accordingly, it is intended to embrace within the invention all such alternatives, modifications and variations that fall within the spirit and scope of the appended claims.

I claim:

1. A floating offshore platform containing a plurality of substantially vertical and rigid risers extending upward from the floor of a body of water, said platform comprising:

(a) a buoyant and ballastable hull containing a passageway;

(b) a buoyant and ballastable riser support structure located inside said passageway and comprising a plurality of tubes, wherein each of said risers (1) passes through one of said tubes such that each tube contains a single riser and (2) is attached to the inside of said tube at a location below the surface of said body of water and below the center of buoyancy of said buoyant and ballastable riser support structure and wherein said buoyant and ballastable riser support structure is devoid of vertical tethers and flexible moorings; and (c) means in each of said tubes for attaching said riser to the inside of said tube, wherein said support structure is free to move in the axial direction inside of said passageway independent of the axial movement of said hull.

2. The floating offshore platform defined by claim 1 wherein said attaching means comprises a latching mechanism.

3. The floating offshore platform defined by claim 1 wherein said risers are not attached to said hull.

4. The floating offshore platform defined by claim 1 wherein each of said risers is attached to said buoyant and ballastable riser support structure at a location within the bottom third of the height of said structure.

5. The floating offshore platform defined by claim 1 wherein each of said risers is attached to said buoyant and ballastable riser support structure at a location within the bottom half of the height of said structure.

6. The floating offshore platform defined by claim 1 wherein said buoyant and ballastable hull is not a spar.

7. The floating offshore platform defined by claim 1 wherein said buoyant and ballastable riser support structure is not a tension leg platform.

* * * * *